US007484982B1

(12) United States Patent
Royle

(10) Patent No.: US 7,484,982 B1
(45) Date of Patent: Feb. 3, 2009

(54) COUPLING FOR A HAND HELD APPLIANCE

(75) Inventor: Terence Gordon Royle, Hampshire (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 11/897,816

(22) Filed: Aug. 31, 2007

(51) Int. Cl.
*H01R 4/66* (2006.01)

(52) U.S. Cl. ..... 439/311

(58) Field of Classification Search ..... 439/311, 439/314, 318, 335, 334, 337; 30/43.92, 34.1, 30/216
See application file for complete search history.

(56) References Cited

U.S. PATENT DOCUMENTS

| | | | | |
|---|---|---|---|---|
| 5,029,973 | A * | 7/1991 | Rink | 385/60 |
| 5,131,147 | A * | 7/1992 | Plevyak et al. | 30/43.92 |
| 5,209,678 | A * | 5/1993 | Allen et al. | 439/672 |
| 5,530,334 | A * | 6/1996 | Ramspeck et al. | 361/600 |
| 6,634,896 | B1 * | 10/2003 | Potega | 439/218 |
| 7,367,126 | B2 * | 5/2008 | Freund et al. | 30/41.7 |
| 2005/0168816 | A1 * | 8/2005 | Fukaishi et al. | 359/465 |
| 2005/0217115 | A1 * | 10/2005 | Blaustein et al. | 30/34.1 |
| 2006/0168816 | A1 | 8/2006 | Wetzell et al. | |
| 2008/0010834 | A1 * | 1/2008 | Oglesby et al. | 30/34.05 |
| 2008/0052914 | A1 * | 3/2008 | Bednar | 30/216 |

FOREIGN PATENT DOCUMENTS

| | | |
|---|---|---|
| EP | 0 457 525 | 11/1991 |
| GB | 1 568 210 | 5/1980 |
| WO | WO 2005/077613 | 8/2005 |
| WO | WO 2006/089715 | 8/2006 |

OTHER PUBLICATIONS

U.S. Appl. No. 11/897,561, filed Aug. 31, 2007, Terence Gordon Royle.
U.S. Appl. No. 11/897,839, filed Aug. 31, 2007, Terence Gordon Royle.
U.S. Appl. No. 11/897,811, filed Aug. 31, 2007, Terence Gordon Royle.
www.braun.com/na/cruzer/cruzer.html—Braun Cruzer product website. Product description (23 pgs), Jul. 2004.

* cited by examiner

*Primary Examiner*—Alexander Gilman
(74) *Attorney, Agent, or Firm*—Brion A. Berman; Kevin C. Johnson

(57) ABSTRACT

An operating head, such as a hair trimming device, is mechanically and electrically connected to a power supply unit, for example in the form of a handle, by a bayonet coupling, with a female member on the handle and a male member on the trimming device. The male member has a plug part that engages slidably into a sleeve portion of the female member and has pin projections for cooperation with bayonet slots in the sleeve portion. Electrical contacts are arranged centrally within the plug part and the sleeve portion which themselves form further electrical contacts. A shroud surrounds the male member and engages the handle through a seal to prevent water ingress to the electrical contacts.

12 Claims, 6 Drawing Sheets

COUPLING FOR A HAND HELD APPLIANCE

FIELD OF THE INVENTION

This invention relates to a coupling for electrically and mechanically connecting a power supply unit to an operating head in a hand-held appliance. The invention has particular application to and is described herein specifically in relation to a coupling for connecting a handle of a battery-operated personal care appliance in which the battery is accommodated in the handle, to an operating head, such as a safety razor head, a hair trimmer head, a massager or the like, the operating head including an electrical device that in use is powered by electric current supplied from the battery.

BACKGROUND OF THE INVENTION

A very well known kind of coupling is a bayonet coupling in which a male coupling member is insertable into a cylindrical sleeve portion of a female member and has radially projecting pins for cooperation with slots formed in the sleeve portion. Such bayonet couplings are widely used to provide secure, but releasable mechanical connections between two parts. Bayonet couplings are also widely used for obtaining disconnectable electrical connections, such as in connecting a light bulb removably to a lamp holder. However, alternative coupling arrangements have generally been relied upon for use where a strong waterproof electrical connection is desired between parts that are also to be secured together firmly, as may be required in a hand-held personal care appliance, such as a safety razor which is immersed in water in normal use.

SUMMARY OF THE INVENTION

With the foregoing in mind, there is provided by the present invention a coupling for electrically and mechanically connecting a power supply unit to an operating head in a hand-held appliance, the coupling comprising complementary male and female members, the female member including an inner first electrical contact and a cylindrical outer sleeve portion, the male member including a part slidably engageable in the sleeve portion and having a radial projection for engagement with a bayonet slot formed in the sleeve portion for releasably locking the male member to the female member, the male member including a second electrical contact for electrical connection with the first electrical contact of the female member, and the sleeve portion and the male part providing further electrical contacts insulated from the first and second electrical contacts.

When the power supply unit forms a handle of the hand-held appliance, the coupling of the invention can ensure a reliable electrical connection whilst enabling a rugged construction to lock the operating head securely to the handle to prevent relative movement between the handle and operating head during use of the appliance, but also permitting easy separation and re-attachment of the operating head to the handle, for example in the course of exchanging one form of operating head with another for use with the same handle and power supply.

Conveniently at least one of the first and second contacts that are respectively located within the female and the male members is spring-loaded, which in addition to assisting electrical contact between the contacts when the coupling members are engaged, can also be effective to urge the projection on the male part into a locking recess provided at the end of the bayonet slot.

In a preferred embodiment a sealing element is provided for sealing the female member to male member externally of the sleeve portion to prevent ingress of moisture into the assembled coupling. The male member can include a sealing shroud for enclosing the sleeve portion and an annular seal is preferably positioned to extend around the sleeve portion axially inwardly of the bayonet slot or slots for cooperation with the shroud so that the electrical contracts are completely enclosed when the male and female members are locked together.

Conveniently the female member is provided on the handle, for example at the end of an elongate handle which houses a battery compartment as well as electrical conductors for connecting the electrical contacts to the respective terminals of the battery disposed in the battery compartment. The handle can also incorporate a switch to control delivery of electrical current from the battery to the operating head, and possibly also to control supply of recharging current to a rechargeable battery accommodated in the battery compartment.

Different forms of operating head can be provided for use with the power supply unit. For example an operating head may include an electric motor connected electrically to the electric contacts of the male coupling member for receiving an electric driving current delivered from the power supply unit. Specific forms of operating head that can be provided include a wet razor head adapted to mount a safety razor cartridge and having a vibration generating device driven by a motor included in the operating head, a liquid dispensing razor head adapted to mount a safety razor cartridge and having a liquid dispensing device driven by a motor included in the operating head, a hair trimmer with one or more blade assemblies arranged to be driven by a motor included in the operating head, a massaging device with a massaging member driven by a motor in the operating head, and an exfoliating device.

The foregoing and other features and advantages of the invention will be more fully understood from the following detailed description of a preferred embodiment.

DETAILED DESCRIPTION OF THE INVENTION

Figure 1:
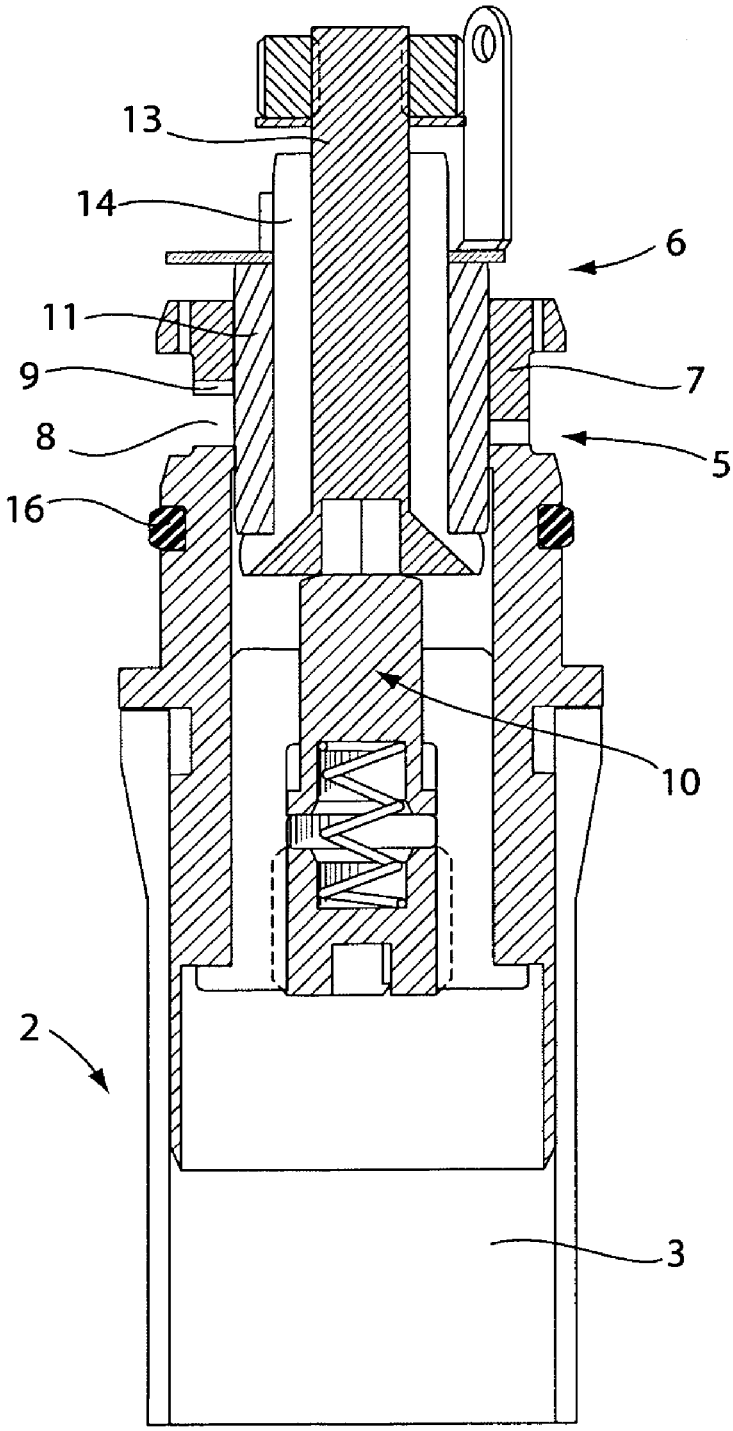
FIG. 1 is an axial cross section through a coupling according to the invention with the male and female members assembled and locked together.
Figure 2:
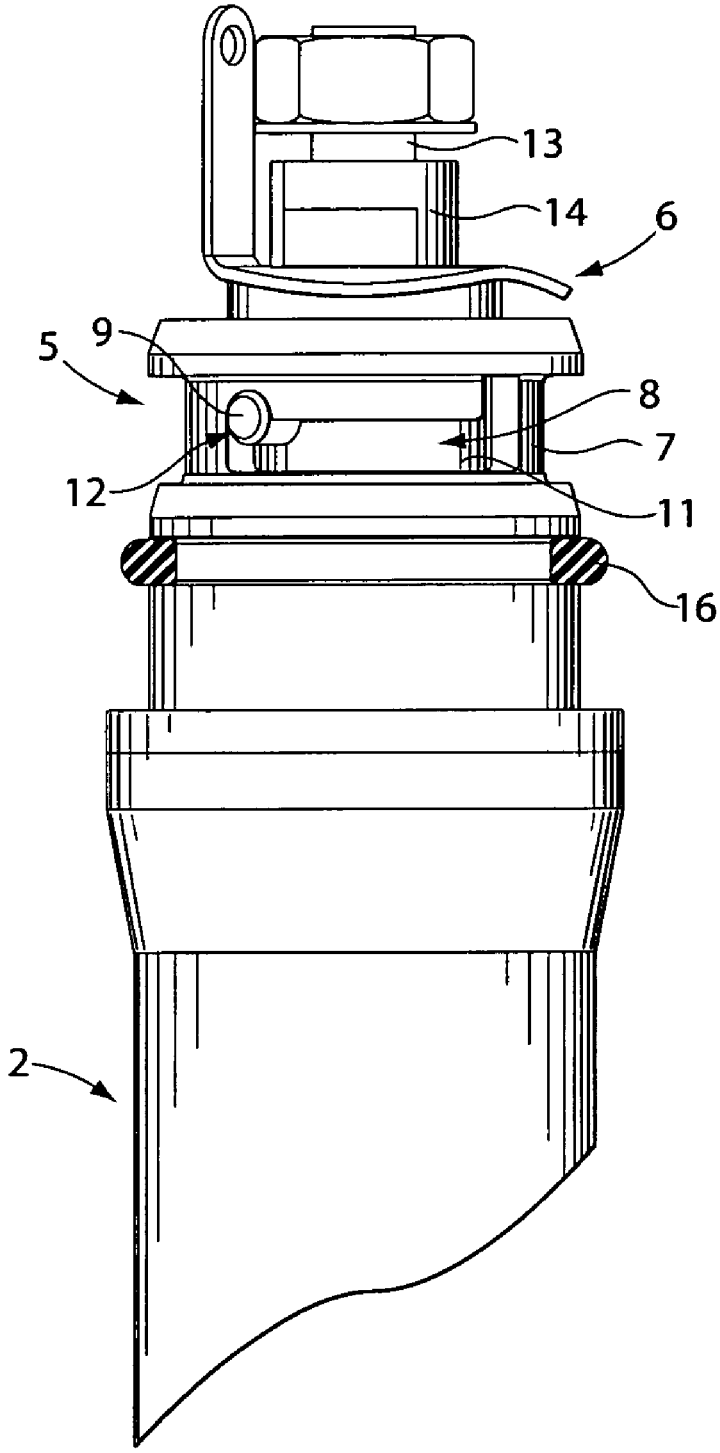
FIG. 2 is a side elevation of the assembled coupling shown in FIG. 1.
Figure 3:
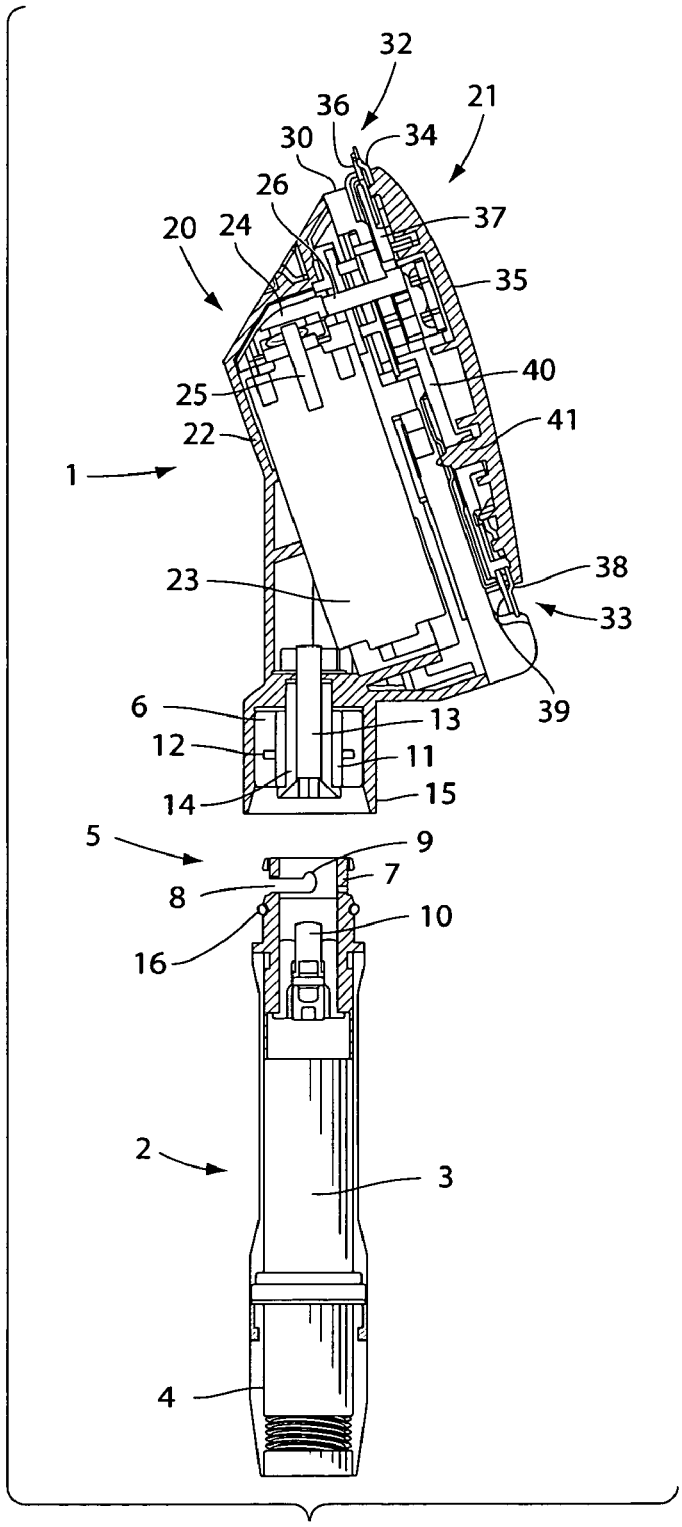
FIG. 3 is an axial section through an appliance handle, and a an operating head in the form of a hair trimming device, respectively provided with the female and male coupling members of a coupling as shown in FIGS. 1 and 2.
Figure 4:
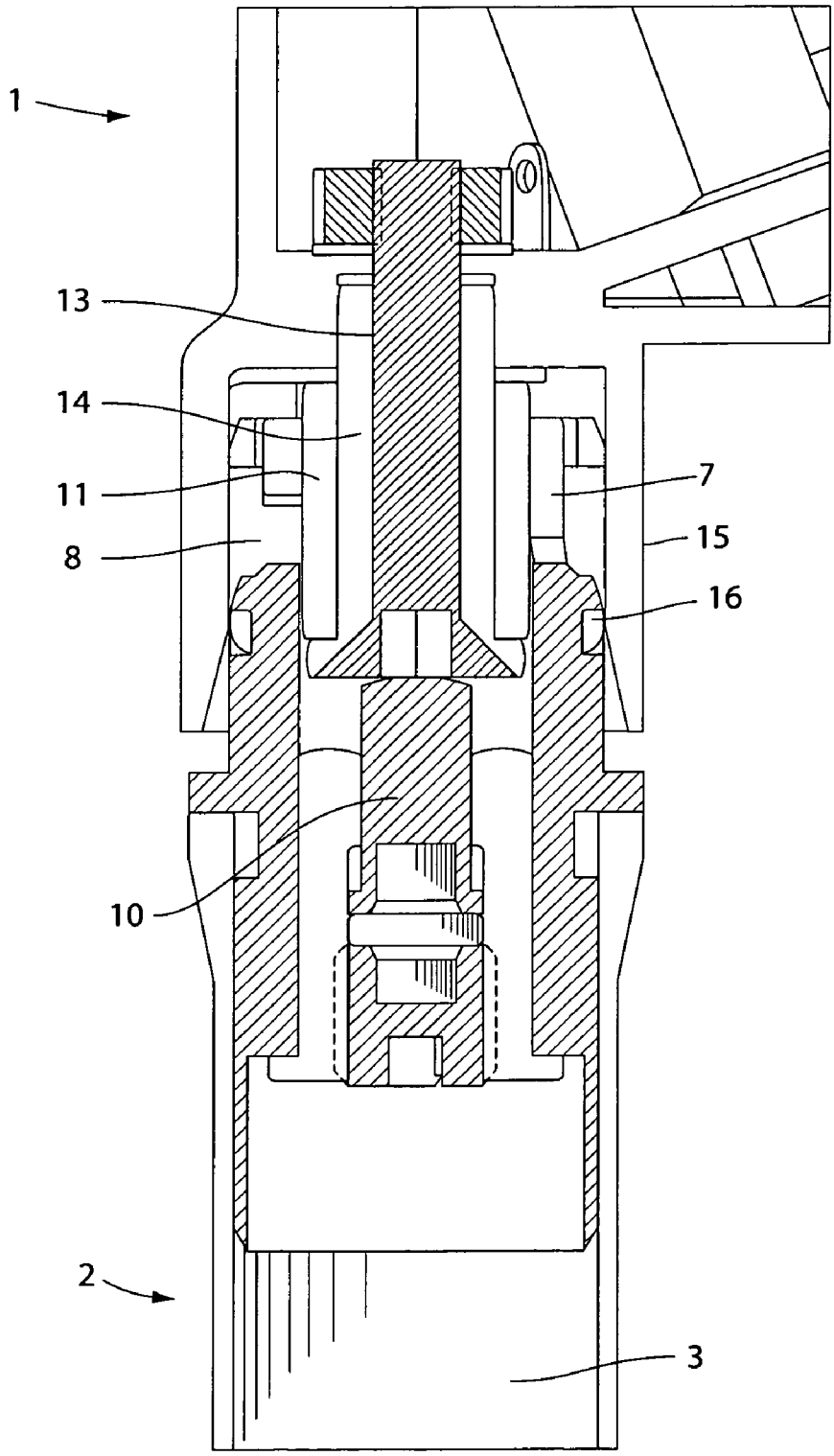
FIG. 4 is an enlarged axial cross section through the assembled coupling of the handle and hair trimming device shown in FIG. 3.

Illustrated in FIG. 3 of the drawings is a hand held personal grooming appliance comprising a hair trimming device 1 and a handle 2 which forms a power supply unit to which the trimming device is adapted to be detachably connected. The handle 2 includes a battery compartment in which a rechargeable battery 3 is accommodated, and a switch arrangement 4 for controlling supply of electric current from the battery 3 to the trimming device when mounted to the handle. A coupling in accordance with the present invention is provided for electrically and mechanically connecting the handle to the trimming device, the coupling comprising a female coupling member 5 on the handle 2 and a male coupling member 6 on the trimming device 1. The coupling is shown on an enlarged scale in FIGS. 1, 2 and 4. The female coupling member 5 includes a sleeve portion 7 located at the upper end of the handle and provided with a pair of symmetrical bayonet slots 8 with locking recesses 9 at their ends. Positioned centrally within the sleeve portion 7 is a first electrical contact 10 in the form of a pin which is spring-loaded and urged axially towards the upper end of the handle. The male coupling member 6 has a plug part 11 adapted to mate with the female coupling member by sliding engagement in the sleeve portion 7, and the plug part has a pair of diametrically opposed pin projections 12 arranged for cooperation with the respective bayonet slots 8. A second electrical contact 13 is located centrally within the plug part 11 with an electrical insulator 14 being disposed therebetween. When the male and female coupling members 5, 6 are fully engaged the first and second contacts 10, 13 are pressed into close abutment due to the spring loading of the first contact, and this spring loading also serves to urge the pin projections 12 into the locking recesses 9 of the bayonet slots 8 to secure the trimming device 1 against unintentional disconnection from the handle 2. Additional spring forces can be applied by spring mounting the central contact 13 in the male plug part 11. The sleeve portion 7 and the plug part 11 form further electric contacts that cooperate to complete a circuit for the flow of electric current between the battery in the handle and the trimming device. Preferably the central contacts 10, 13 provide the positive polarity connection and the contacts 7, 11 the negative polarity connection of the electrical connector. The trimming device 1 includes a hood or shroud 15 which surrounds the plug part 11 for enclosing the male and female members of the bayonet coupling to preclude ingress of moisture to the electrical contacts. The female member carries an annular seal 16, such as an O-ring seal, disposed in a peripheral groove provided on the sleeve portion 7 axially inwardly of the bayonet slots 8, and the shroud 15 has a close fit over the seal 16 to ensure a watertight connection between the shroud and the handle when the male and female coupling members are engaged.

Figure 5:
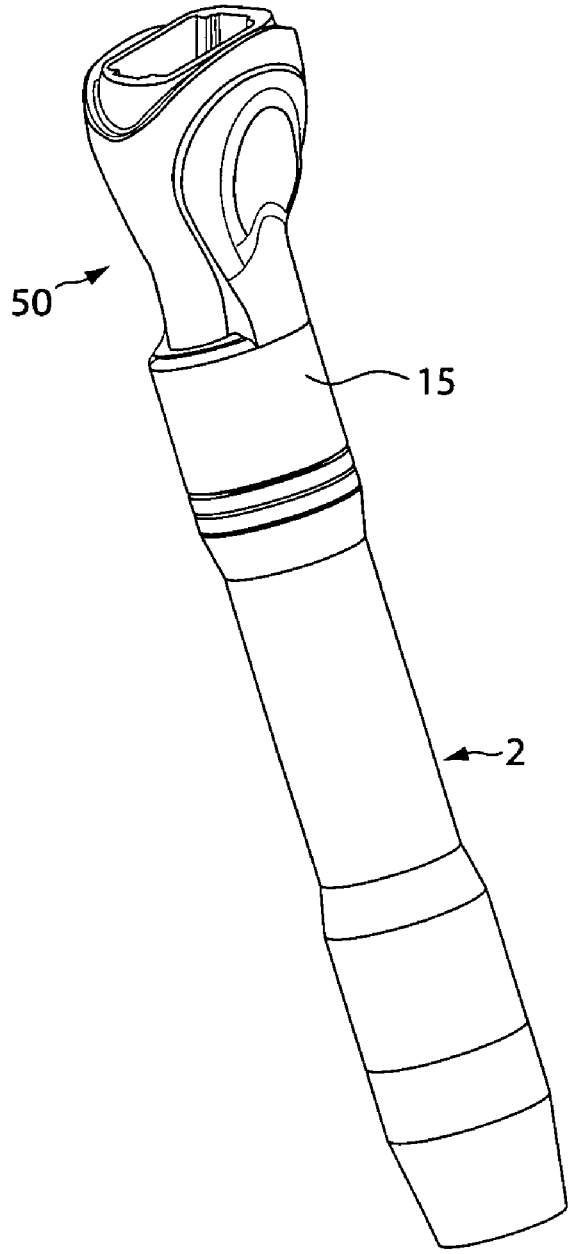
FIG. 5 is a perspective view of the handle assembled with a safety razor operating head adapted to mount a conventional safety razor cartridge.
Figure 6:
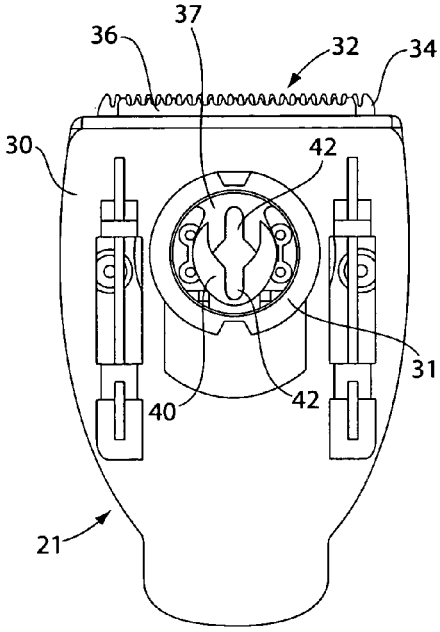
FIG. 6 is a rear elevation of the trimmer unit of the trimming device as shown in FIG. 3 with a first blade assembly in the operative position.
Figure 7:
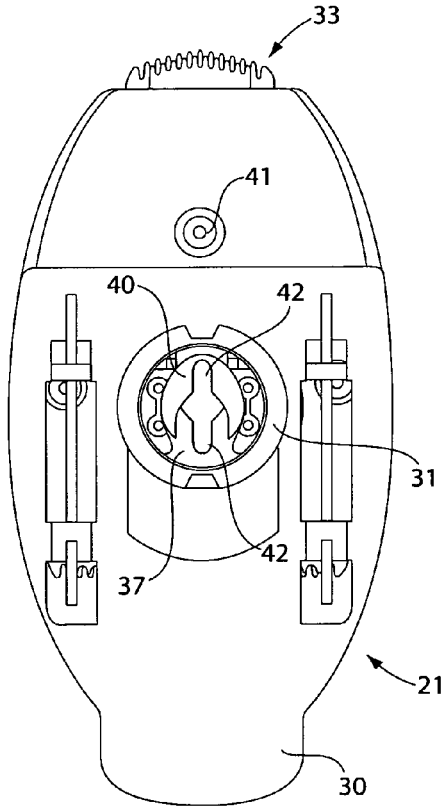
FIG. 7 is a rear elevation of the trimmer unit of the trimming device as shown in FIG. 3 with a second blade assembly in the operative position.
Figure 8:
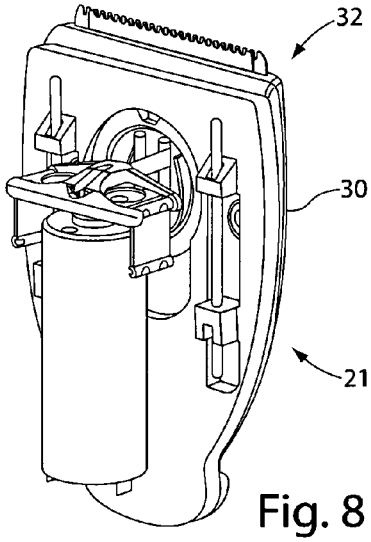
FIG. 8 is a perspective illustration showing a motor and transmission of a drive unit in assembly with the trimmer unit.

The bayonet coupling provides a firm and secure mechanical connection between the handle and the hair trimming device while also ensuring a good electrical connection between them. Furthermore, the coupling can be easily opened to separate the trimming device from the handle, such as to enable the battery to be recharged and/or a different form of operating head to be operatively connected to the handle, such a safety razor head 50 as shown in FIG. 5 which is adapted to receive a conventional shaving cartridge and which may include a motor for driving a vibration generating device, such as a coin motor. As will be appreciated the coupling employed to connect the safety razor head 50 to the handle 2 may be exactly as described above with respect to the trimming device 1, with the shroud 15 being sealed to the handle so that water can not reach the electrical contacts even when the razor head is completely immersed in water for rinsing the shaving cartridge.

The trimming device includes a drive unit 20 and a trimmer unit 21. The male coupling member 6 and the shroud 15 are provided on a housing 22 of the drive unit in which is housed an electric rotary motor 23 and a transmission mechanism 24 for converting rotary motion of a motor shaft 25 into reciprocation of a drive output member 26 in the form of a drive pin. The electric terminals of the motor are connected to the electrical contacts 11 and 13 of the trimming device for supply of current from the battery 3 in the handle for driving the motor. Connected to the front of the drive unit is a mounting plate 30 for the trimmer unit 21, the mounting plate being guided for up and down translatory movement relative to the drive unit for purposes which will become clear. The trimmer unit is held to the mounting plate 30 so that the trimmer unit 21 is able to rotate relative to the mounting plate 30 and hence also the drive unit 20. The trimmer unit includes a first trimmer blade assembly 32 and a second trimmer blade assembly 33. The first blade assembly 32 is comparatively long and straight and includes a first trimmer blade 34 fixedly mounted to a face plate 35 of the trimmer unit, and a second trimmer blade 36 guided for reciprocation relative to the first trimmer blade and attached to a blade driving element 37. The second blade assembly 33 is relatively short with a convex profile and includes a first trimmer blade 38 fixedly mounted to the face plate 35 and a second trimmer blade 39 guided for reciprocation along a curved path relative to the first trimmer blade 38 and attached to a blade driving element 40 which is mounted to the face plate 35 by a pivot 41. Each of the blade driving elements 37, 40 includes a slot 42 in which the drive output pin 26 is engageable for reciprocating the blade driving element and also reciprocating the trimmer blade attached to the blade driving element.

When the mounting plate 30 is displaced upwardly relative to the drive unit the trimmer unit 21 can be rotated relative to the mounting plate to selectively adjust either the first blade assembly 32 or the second blade assembly 32 to the operative position. Downward displacement of the mounting plate 30 and the trimmer unit then causes the drive output pin 26 to engage in the slot in the blade driving element 37 or 40 of the trimmer blade assembly 32 or 33 disposed in the operative position. Actuation of the motor 23 then puts the selected trimmer blade assembly into operation whilst the other trimmer blade assembly remains uncoupled from the drive output pin 26.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

All documents cited in the Detailed Description of the Invention are, in relevant part, incorporated herein by reference; the citation of any document is not be construed as an admission that it is prior art with respect to the present invention. To the extent that any meaning or definition of a term in this written document conflicts with any meaning of definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A coupling for electrically and mechanically connecting a power supply unit to an operating head in a hand-held appliance, the coupling comprising complementary male and female members, the female member including an inner first electrical contact and a cylindrical outer sleeve portion, the male member including a part slidably engageable in the sleeve portion and having a radial projection for engagement with a bayonet slot formed in the sleeve portion for releasably locking the male member to the female member, the male member including a second electrical contact for electrical connection with the first electrical contact of the female member, and the sleeve portion and the male part providing further electrical contacts insulated from the first and second electrical contacts, wherein the power supply unit forms a handle of the hand-held appliance.

2. The coupling of claim 1, wherein at least one of the first and second contacts is spring loaded for urging the projection into a locking recess provided at the end of the bayonet slot.

3. The coupling of claim 1, wherein the male part has a pair of diametrically opposed projections for engagement with respective bayonet slots in the sleeve portion.

4. The coupling of claim 1, wherein a sealing element is provided for sealing the female member to the male member externally of the sleeve portion.

5. The coupling of claim 4, wherein the male member has a sealing shroud for enclosing the sleeve portion.

6. The coupling member of claim 5, wherein an annular seal extends around the female member axially inwardly of the bayonet slot for sealing cooperation with the shroud.

7. The coupling member of claim 1, wherein the female member is located at an end of an elongate handle of the electrical appliance, the handle housing a battery compartment and electrical conductors for connecting the first electrical contact and the sleeve portion to respective terminals of a battery accommodated in the battery compartment.

8. The coupling of claim 7, wherein the handle includes a switch to control delivery of electrical current from the battery to the operating bead.

9. The coupling of claim 8, wherein the switch is operable to control supply of recharging current to a rechargeable battery accommodated in the battery compartment.

10. The coupling of claim 1, wherein the operating head comprises an electrical motor electric connected to the second contact and to the male part for the motor to be driven by the power supply unit.

11. The coupling of claim 10, wherein the operating head is arranged to carry a safety razor cartridge and includes a vibration generating device driven by the motor.

12. The coupling of claim 10, wherein the operating head comprises a hair trimmer with a blade assembly coupled to be driven by the motor.

* * * * *

UNITED STATES PATENT AND TRADEMARK OFFICE

CERTIFICATE OF CORRECTION

PATENT NO. : 7,484,982 B1
APPLICATION NO. : 11/897816
DATED : February 3, 2009
INVENTOR(S) : Terence Gordon Royle It is certified that error appears in the above-identified patent and that said Letters Patent is hereby corrected as shown below:

Column 2

Line 50, delete the "a" in front of the word an.

Column 6

Line 14, delete "bead" and insert --head--.

Signed and Sealed this

Twenty-fifth Day of May, 2010

David J. Kappos

David J. Kappos
*Director of the United States Patent and Trademark Office*